US005637931A

United States Patent [19]

Hsu

[11] Patent Number: 5,637,931

[45] Date of Patent: Jun. 10, 1997

[54] SAFETY APPARATUS FOR AN ELECTRICAL IRON

[75] Inventor: Tony Hsu, Yung Kang, Taiwan

[73] Assignee: Lundar Electric Industrial Co., Ltd., Tainan Hsien, Taiwan

[21] Appl. No.: 594,847

[22] Filed: Jan. 31, 1996

[51] Int. Cl.[6] ..... H01H 35/02

[52] U.S. Cl. ..... 307/116; 307/119; 307/120; 219/245; 219/250; 219/25.7; 38/74; 248/117.1

[58] Field of Search ..... 307/116, 119, 307/120; 219/250, 257, 245; 38/74; 248/117.1

[56] References Cited

U.S. PATENT DOCUMENTS

| | | | |
|---|---|---|---|
| 4,520,257 | 5/1985 | Schwob et al. | 219/250 |
| 4,577,424 | 3/1986 | Liu | 38/88 |
| 4,803,342 | 2/1989 | Steers et al. | 219/257 |
| 5,380,983 | 1/1995 | Cavada et al. | 219/250 |

*Primary Examiner*—John W. Cabeca
*Assistant Examiner*—Albert W. Paladini
*Attorney, Agent, or Firm*—Morton J. Rosenberg; David I. Klein

[57] ABSTRACT

A safety circuit for an electrical iron is provided comprising a double through position sensitive switch having a common contact that is connectable to connect a horizontal position sensing contact and a vertical position sensing contact. When the iron is in use, the common contact will continually shift its contact between the two position sensing contacts, which enables the coupling of power to the heating circuit of the iron. When the iron is placed either horizontally or vertically, a delay timer of a control unit will start to count passage of time. When a preset time has elapsed, the control unit will deactivate the coupling of power to the iron's heating circuit. However, during this period when time is being counted or subsequent to the deactivation of power, if use of the iron is resumed, the control unit delay timer will start to count from the very beginning and the power will be activated again.

2 Claims, 6 Drawing Sheets

SAFETY APPARATUS FOR AN ELECTRICAL IRON

BACKGROUND OF THE INVENTION

Field of the Invention

The present invention relates to a safety apparatus for an electric iron. More particularly, the present invention is directed to an improved safety control circuit which enables the power to be cut off automatically after the iron has been placed in an idle state or not in use for a certain period of time, and to reinstate the power supply to the iron when the iron is in operation again.

As the quality of life is improved daily, people are paying more attention to their dress. A clean and well trimmed suit has become essential, which requires an iron to make it suitably well-rimmed. Currently, most of the irons on the market are provided with a temperature adjustment function for the user to select the most favorable temperature for the material of the clothing. An over temperature switch may be available in the iron to cut off power automatically when the temperature of the iron indicates that it is overheated.

However, the over temperature switch of the conventional iron is a passive overheat control. It detects only the internal temperature of the iron to decide whether the power is to be cut off or on, but does not measure the ambient temperature. That cannot prevent an accident which may be caused by carelessly leaving the iron on clothes. Even if the user has temporarily placed the iron in an upright position, the iron is still in a high temperature state on its surface, which may hurt someone, in particular, may hurt children who do not know that the iron is in operation.

SUMMARY OF THE INVENTION

According to the above discussed shortcomings of the conventional iron, a main object of the present invention is to provide an iron having a safety circuit that can automatically and temporarily cut off power if the iron is not in use for a certain period of time, in order to avoid the occurrence of an accident.

Another object of the present invention is to provide a safety circuit which enables a user to preset a time period before cutting off power.

A further object of the present invention is to provide a safety circuit which will resume power subsequent to sensing a change in position of the iron.

In order to achieve the above mentioned objects, the present invention is essentially composed of a double through switch, a control unit and an oscillating circuit.

DETAILED DESCRIPTION OF THE PREFERRED EMBODIMENT

Figure 1:
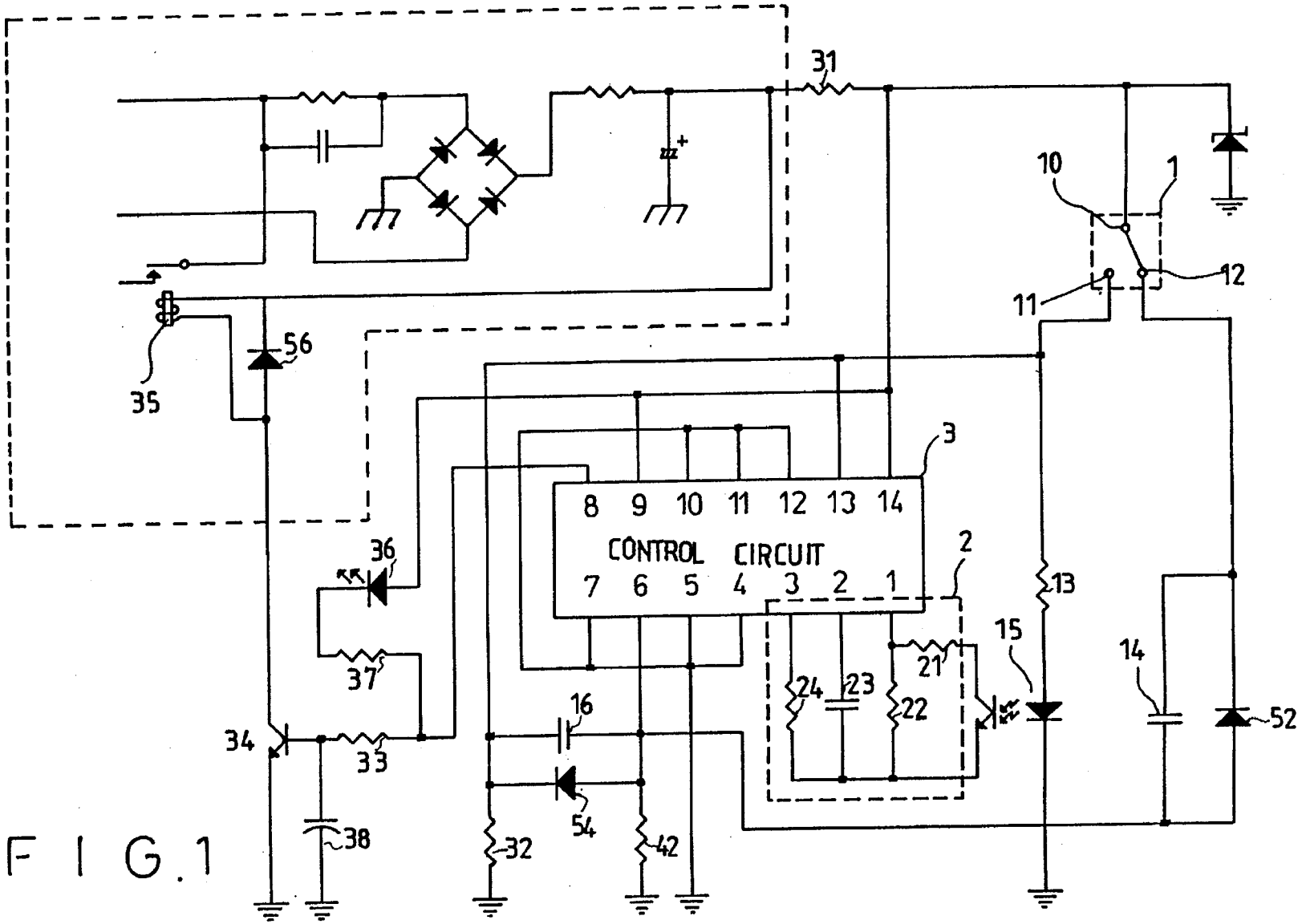
FIG. 1 is a circuit diagram of the present invention.

As shown in FIG. 1, the present invention includes a double through switch 1, an oscillating circuit 2 and a control circuit 3.

The double through switch i may be either a magnetic reed switch, a ball switch or a mercury switch. Owing to the fact that the size of ball switches and magnetic reed switches are too large, take up too much space, and are more expensive, the mercury switch is considered the preferred type of double through switch. The double through switch 1 includes three contacts 10, 11 and 12. The contact 10 is a common contact, the contact 11 is in contact with contact 10 when the iron is in a horizontal position, and the contact 12 is in contact with contact 10 when the iron is in an upright position. The contact 12 is connected to the 6th pin of the control circuit 3 through a capacitor 14 in parallel with a reverse biased diode 52, and a resistor 42, and the contact 11 connects to the oscillating circuit 2 through a resistor 13 and a photo-coupler 15. The contact 11 also is connected to pin 6 through a capacitor 16 in parallel with a reverse biased diode 54, and a resistor 32. Therefore, a resetting trigger pulse signal is generated when the double through switch 1 is changed, the pulse being coupled to the 6th pin of the control circuit 3 through the capacitors 14 and 16, respectively.

The oscillating circuit 2 is an external unit connected to the pins 1, 2 and 3 of the control circuit which together form an oscillator. The circuit 2 includes resistors 21, 22, 24 and capacitor 23 in a series connection with respect to the pins 1, 2 and 3, for setting the frequency of the oscillator. When the iron is placed in a horizontal position, the contact 11 closes, is connected to contact 10, and a high level is coupled through the resistor 13 to drive the photo-coupler 15 to switch on. When photo-coupler turns on, the resistors 21 and 22 of the oscillating circuit 2 are connected to the pin 1 of the control circuit 3, in parallel, to reduce the RC time constant of the circuit, increasing the oscillator frequency, and thereby minimize a delay time established within the control circuit 3. When the iron is placed in an upright position, the contact 12 closes the contact 10 being connected thereto, and the contact 11 opens. The high level signal will thereby be removed from the photo-coupler 15. With the photo-coupler 15 being open, the oscillating circuit 2 will have the resistor 22 connected to the pin 1 of the control circuit without resistor 21, which increases the RC time constant of the circuit, decreasing the oscillator frequency, and thereby increasing the delay time of control circuit 3, since the resistor 22 has a larger resistance value than that of the parallel combination of resistors 21 and 22.

The control circuit 3 is an integrated circuit having its pins 9 and 14 connected to the pin 8 through a light emitting diode 36 and a resistor 37 forming a cut-off display circuit. The positive power supply voltage is coupled to pins 9 and 14 through the resistor 31. The pin 8 is connected to a resistor 33, a capacitor 38, and an amplifier 34, the amplifier 34 being coupled, a relay 35 coupled in parallel with a reverse biased diode 56, to form a logic circuit to turn the iron on and off. When the iron is in operation, the double through switch 1 continually shifts between closure of the contacts 11 and 12 as the iron is displaced by the user, to output a continuous signal to pin 6, to reset the delay time function of the control circuit 3. In this case, the delay timer function in the control circuit 3 remains in a reset state, which keeps the control circuit 3 in an active state, where pin 8 outputs a high level signal triggering the amplifier 34 to close relay 35 and thereby apply power to the heating circuit of the iron. When the iron is in this active state, the control circuit 3 outputs a positive, high level, signal from pin 8, and with a like signal on the anode of the light-emitting diode 36, diode 36 is turned off.

Figure 2:
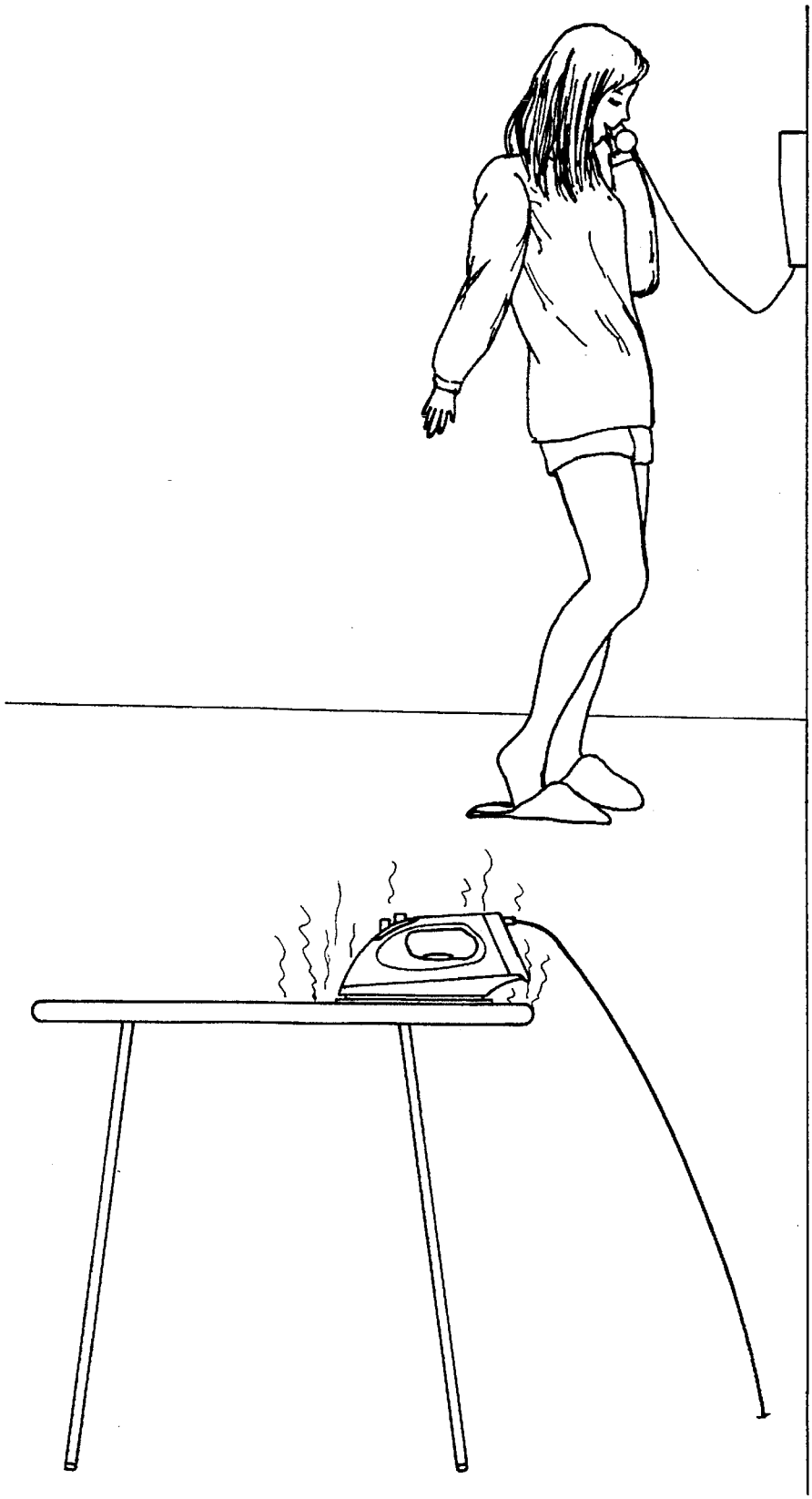
FIG. 2 is a schematic diagram showing an iron placed in a level position.

When the iron is turned on and is placed in a horizontal position, as shown in FIG. 2, the contact 10 of the double through switch 1 is in constant contact with contact 11. After a period of time, the control circuit 3 will receive a positive signal only through pin 13, with pin 6 having no input signal to now activate the reset circuit, a delay timer can begin to count. At the same time, a high level signal from the resistor 13 coupled to the photo-coupler 14 reduces the time constant of the oscillating circuit 2. After a predetermined delay time has elapsed, pin 8 of the control circuit 3 outputs a low level signal to the amplifier 34 to cut off power of the iron, temporarily.

Figure 3:
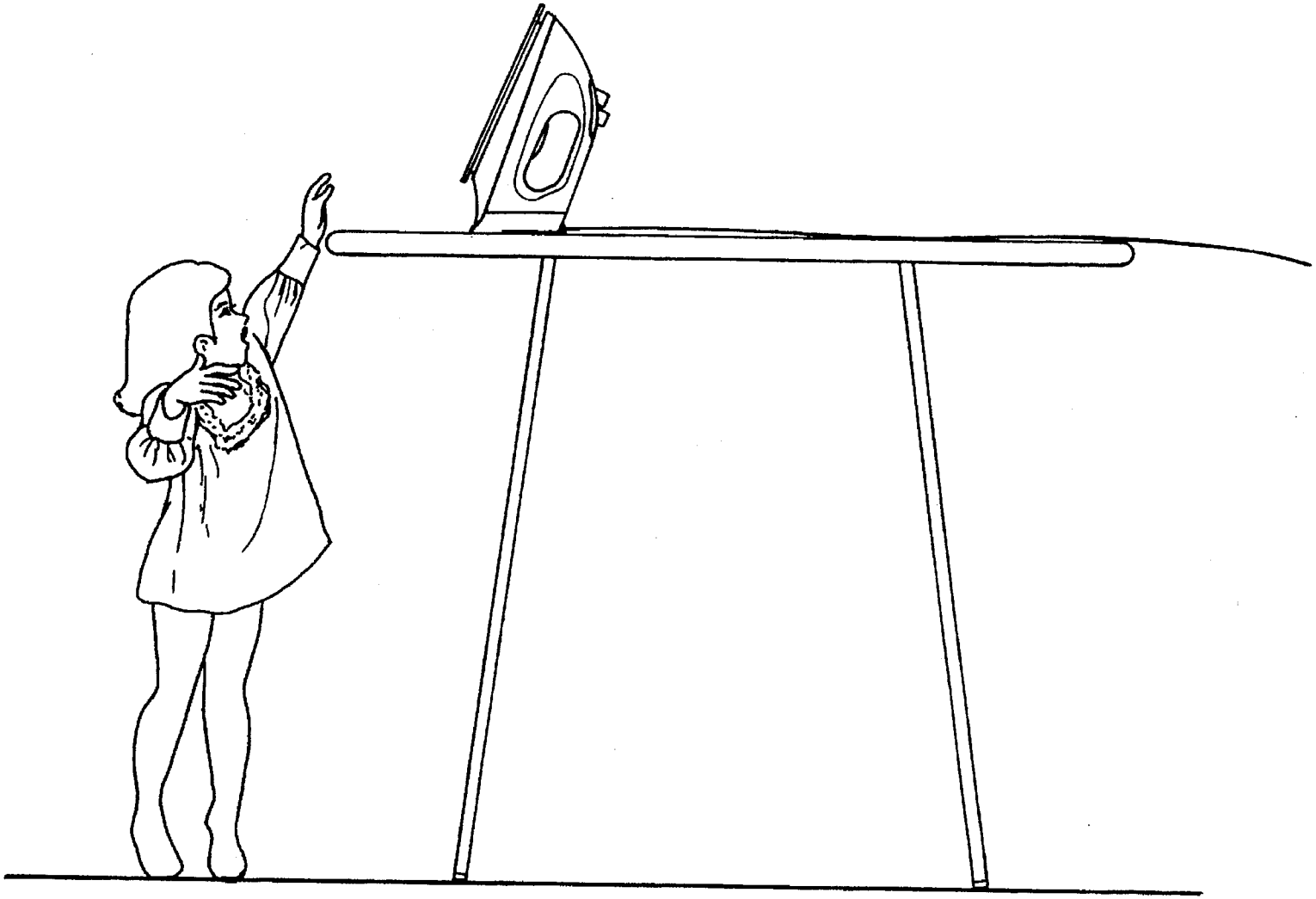
FIG. 3 is a schematic drawing showing the iron placed in an upright position.

When the iron is turned on and is placed in a vertical position, as shown in FIG. 3, the contact 10 of the double through switch 1 is in contact with contact 12. After a period of time, pin 6 of the control circuit 3 will no longer receive a signal through capacitor 14, and the delay timer of control circuit 3 is started again to count time. When the delay time has elapsed, pin 8 of the control circuit 3 outputs a low level signal which the limit emitting diode 36 to conduct, and the amplifier 34 cut off. With amplifier 34 off, the relay 35 is in open state, which cuts off power supplied to the iron.

Should the iron be put in use again subsequent to the delay period having elapsed, the closure of through double switch 1 will again alternate between contacts 11 and 12, which outputs a continuous reset signal to pin 6. The pin 8 will output a high level signal through resistor 33 to the amplifier 34, to close the relay 35. The light emitting diode 36 is deactivated by the high level signal supplied to its cathode from pin 8, through resistor 37. The reset circuit, at this time, continually restarts the delay timer to count from the beginning point.

Figure 4:
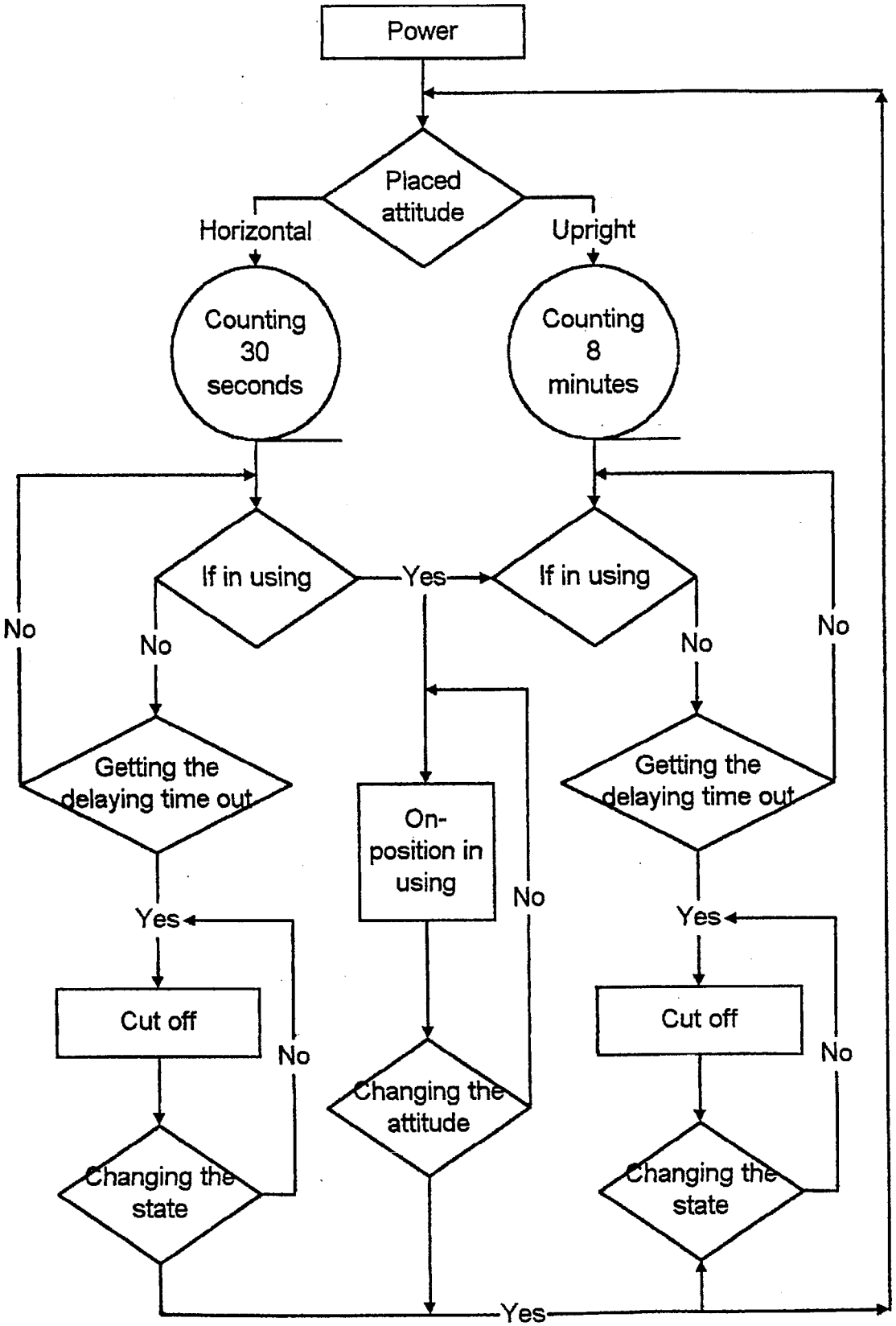
FIG. 4 is a flow chart illustrating the functions performed by the present invention.
Figure 5A:
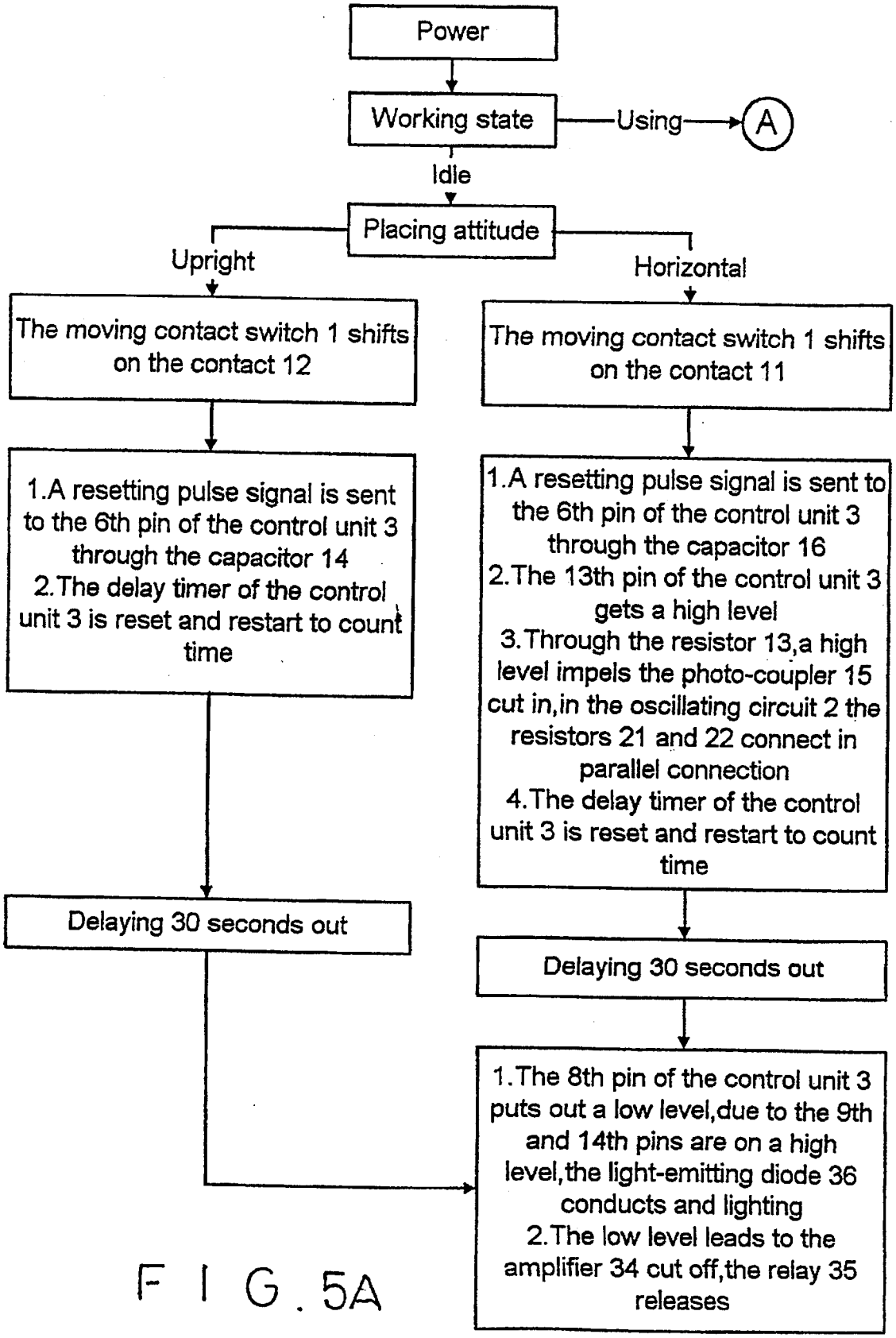
FIG. 5A and FIG. 5B are flow-processing diagrams of the present invention.
Figure 5B:
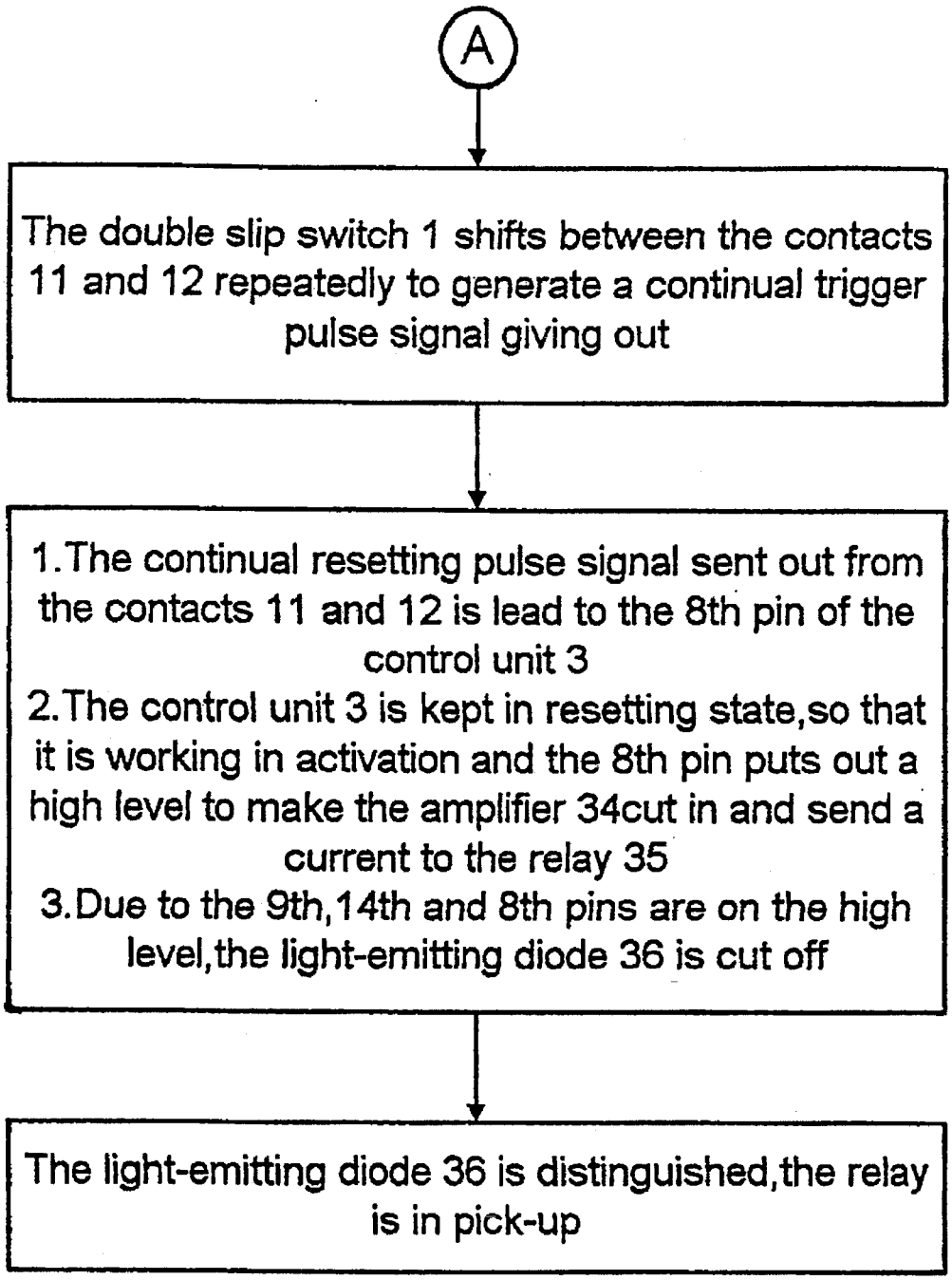

Referring now to the flow charts of FIGS. 4, 5A and 5B, when the power is turned on, the delay timer circuit of the control circuit 3 begins to count the time of the iron's state. Upon the delay timer having reached a preset time, a 30 second delay time for the iron being placed in horizontal position and 8 minutes in vertical position, power to the heating circuit of the iron will be cut off, temporarily. However, should the position of the iron be changed, the delay timer circuit will be reset to start its counting from the very beginning.

I claim:

1. A safety circuit for controlling a heating circuit of an electric iron, comprising:

a power supply;

a position sensitive switch coupled to said power supply for selectively coupling a high level voltage to one of a pair of contacts, a first of said pair of contacts being connected to said high level voltage responsive to the iron being disposed in a horizontal orientation, a second of said pair of contacts being connected to said high level voltage responsive to the iron being disposed in a vertical orientation, said high level voltage being alternately applied to said first and second contacts responsive to displacement of the iron during use;

means for enabling and disabling the iron's heating circuit, said means for enabling and disabling including (1) a relay having a contact operatively coupled to the iron's heating circuit to couple power thereto responsive to a drive signal input to said relay, and (2) an amplifier having an output coupled to said relay for input of said drive signal thereto responsive to a control signal input to said amplifier;

a control circuit having a first input coupled to said power supply for generating said control signal at an output thereof responsive to said high level voltage being received at said first input, said output being coupled to said amplifier, said control circuit having a second input coupled to said first contact of said position sensitive switch for monitoring the iron's orientation, said control circuit including a circuit for generating a timing signal and accumulating a time count for inhibiting generation of said control signal responsive to said time count reaching (1) a first predetermined value when the iron's orientation is horizontal, and (2) a second predetermined value when the iron's orientation is vertical, said control circuit having a second input capacitively coupled to both said first and second contacts of said position sensitive switch for input of a pulse signal responsive to a change in the iron's orientation for resetting said circuit for generating a timing signal and accumulating a time count to restart a time count;

means for establishing a time constant coupled to a plurality of third inputs of said control circuit for establishing a frequency of said timing signal; and, a photo-coupler having an input coupled to said first contact of said position sensitive switch and an output coupled to said means for establishing a time constant for alter a time constant value thereof responsive to the iron's orientation, whereby said alternate application of said high level voltage to said first and second contacts of said position sensitive switch repeatedly inputs said pulse signal to said second input of said control circuit for maintaining said generation of said control signal by repeatedly resetting said circuit for generating a timing signal and accumulating a time count.

2. The safety circuit as recited in claim 1 where said position sensitive switch is a mercury switch.

* * * * *